US005735351A

United States Patent [19]

Helms

[11] Patent Number: 5,735,351

[45] Date of Patent: Apr. 7, 1998

[54] TOP ENTRY APPARATUS AND METHOD FOR A DRILLING ASSEMBLY

[76] Inventor: Charles M. Helms, 1202 Castlewood, Friendswood, Tex. 77546

[21] Appl. No.: 410,894

[22] Filed: Mar. 27, 1995

[51] Int. Cl.[6] ..... E21B 43/00

[52] U.S. Cl. ..... 166/384; 166/77.2

[58] Field of Search ..... 166/77.1, 77.2, 166/88.1, 379, 384, 385

[56] References Cited

U.S. PATENT DOCUMENTS

| | | | |
|---|---|---|---|
| Re. 33,150 | 1/1990 | Boyd | 166/242 |
| 3,116,793 | 1/1964 | McStravick | 166/77.2 |
| 3,690,136 | 9/1972 | Slator et al. | 166/77.2 |
| 5,284,210 | 2/1994 | Helms | 166/385 |
| 5,381,861 | 1/1995 | Crafton et al. | 166/77.2 |

OTHER PUBLICATIONS

Bowen Tools, Inc. 1990–1991 General Catalog "Bowen Measuring Line Stuffing Boxes" p. 553.

*Primary Examiner*—William P. Neuder

[57] ABSTRACT

Apparatus and methods are disclosed for accessing a drill pipe bore through a drill pipe top drive unit. The top drive is carried by a traveling block so it may be used for simultaneous application of rotational and longitudinal force on the drill string. A pack-off body has a shortened effective length due to mounting a flange thereabouts for securing to the top drive unit once a gooseneck circulation flow line has been removed in accordance with the method of the invention. A sheave support arm is mounted in cantilever fashion to the pack-off body and carries thereon two sheave wheels provided at desired locations to direct a wireline cable radially outwardly without frictionally engaging either the traveling block and hook or the top drive unit. The angles of bending of the wireline by placement within the support arm are chosen to prevent damage to the wireline containing an electrical connector.

55 Claims, 8 Drawing Sheets

96
18
10
32
36
27
48
100
38
102
20
34
24
16
40
44
94
49
78
80
14
76
82
56
83

TOP ENTRY APPARATUS AND METHOD FOR A DRILLING ASSEMBLY

STATEMENT OF THE PRIOR ART

1. Field of the Invention

The present invention relates generally to apparatus and methods for providing entry of a flexible member, such as by way of example only, a wireline or coiled tubing, into an upper portion of a drilling assembly and more particularly, to apparatus and methods for supporting the wireline or other member between a lifting means such as a traveling block and hook or elevator and bails, and the rotational drive means such as a top-drive unit, power swivel or rotary table.

2. Description of Prior Art

Certain types of wireline operations, such as free-point back-off operations by way of example only and not by limitation, have been utilized for years to aid in retrieving a drill string that become trapped or stuck in the wellbore during the drilling procedure. When a drill string becomes stuck in the well bore, most often only a portion of the drill string, such as the bottom hole assembly, is actually stuck and the remainder of the drill string above the trapped or stuck portion is free. It is desirable: first, to attempt to discover where the drill string is stuck; second, to attempt to manipulate the drill string free at the stuck point; and, finally, if the drill string cannot be rotated or reciprocated free, to remove the free portion of the drill string from the wellbore by backing off the drill string from the stuck portion of the string. Thereafter, specialized equipment, such as wash pipe, grapples and the like, can be used to free the remainder of the drill string. Alternatively, the stuck portion of the drill string may be abandoned and an offset well may be drilled. However, it is always desirable to retrieve as much of the expensive drill pipe and bottom hole assembly as is possible prior to fishing for the unrecovered portion of the string or cementing the wellbore containing the remaining stuck pipe and commencing drilling in a new direction.

To accomplish these objectives, a specialized wireline tool, sometimes called a free-point tool, may be used to locate the stuck and free regions of the drill string. A free point tool is a highly sensitive electronic device which measures both stretch and torque movement in a string of pipe. The information is transmitted through the electrical conductor cable to a surface control unit where the data is analyzed. Free point tools are often run into the well bore with other wireline tools, such as collar locators and various combinations of cutting tools and string shots to minimize rig down-time. The free-point to be detected is the point in the drill string above which it can be said that the drill string is essentially free. This free portion of the drill string could be removed if it were possible to unscrew this free portion from the stuck portion. However, because the drill string is tightly screwed together with many pipe connections, it is often difficult to unscrew the particular connection that allows removal of all or most of the free portion of drill string from the well bore.

A back-off operation, using a wireline tool, is often utilized to accomplish this purpose because it allows selection of the connection to loosen. To prevent accidental back-off in a loose connection up the hole from the free point, the pipe is first tightened. This is accomplished by applying a specific number of rounds of right-hand torque and then reciprocating the drill string while holding the torque. Torque in the pipe string has been held by attaching pipe torque to the string on the rotary floor and securing the tongs by cable or chain to the leg of the derrick. By counting the rounds of torque make-up and then counting the rounds that "come back" when the tongs or rotary table or top-drive unit is released, rounds of make-up in the threads somewhere in the free pipe are indicated. Using an standard torque parameters known to those skilled in the art, the process is continued until there is no more make-up remaining in the drill string.

After these steps, the drill string is determined to be fully made-up and the pipe recovery personnel begin the operation to back-off at or near the free point as determined by the prior wire-line operations. Left-hand torque is introduced into the drill string. This torque must be worked down the string by again reciprocating the drill string while the torque is again held by the pipe tongs. This action distributes the torque throughout the string and assures that there is left-hand torque at the point of back-off.

A relatively light explosive charge, sometimes called a "string shot," which includes several strips of prima cord, may then be placed across the chosen pipe connection using a wireline. Detonation of this explosive causes the pipe connection, which is under torque, to loosen or back-off the connection. Once the desired connection is loosened, the remainder of the drill string can be retrieved from the well bore.

Immediately prior to firing the string shot, the drill string at the back-off point should be in neutral condition, with neither tension nor compression. This requires the operator to pick-up the drill string with the lifting means to relieve any force on the joint determined to be at the back off point. The left-hand torque is held, and the determined weight of the drill string above the back-off point is picked up by the lifting means when the string-shot is fired. The concussion at the joint momentarily loosens the threads and the pipe begins to unscrew.

During the back-off operation, it is typically necessary to move the pipe string longitudinally by using the lifting means, which are generally described as a hook attached to the traveling block to thereby stretch the pipe string. At the same time, torque may also be applied to the pipe. The object of such effort is to place reverse torque upon the desired pipe connection, just above the stuck portion of the drill string, and also to simultaneously relieve longitudinal tension on that pipe connection so that it is relatively free to rotate or loosen.

It may be readily appreciated from the foregoing description of the manner of back-off that, in order to place torque upon the desired pipe connection, it is often necessary to reciprocate the pipe in a longitudinal direction so as to work the torque through the long and typically winding borehole and simultaneously rotate the pipe to hold the torque in the pipe. While the slips set in the rotary table allow torque to be applied to the drill string, this method does not allow reciprocating movement while simultaneously holding the torque in the string. During this reciprocating process, a relatively heavy pipe tong has often been used to maintain the torque in the drill pipe as the drill string is reciprocated longitudinally. The pipe tong is secured by a cable that is under high tension because of the torque applied to the drill string. This results in a dangerous condition that has frequently caused injury and death when the pipe tong restraint that secured the end of the tongs to the leg of the derrick failed to hold fast. In such a case, the relatively heavy pipe tongs then gyrated out of control at a high speed in the vicinity of the rig floor and caused grave injury and death to operating personnel.

Other wireline entry devices provide side entry to the tubular bore of the drill string above the rotary table, but prohibit simultaneous rotational and longitudinal movement of the drill string and further cause abrasion to the wireline and the tubular members into which the wireline is inserted causing premature failure. Other types of wireline entry devices provide top-entry of the wireline, but do not allow simultaneous rotation and reciprocation of the drilling string.

Various types of pipe rotating drive systems are available that allow rotation or torquing of the drill string while the pipe is moved in an longitudinal direction so that the pipe tong would not be needed. However, wireline has not been heretofore used within the drill pipe while rotating and reciprocating the drill pipe because of possible damage to the wireline.

Further, existing drive systems such as the top-drive system provide very little clearance between the top drive and the hook suspended from the lifting block. Some top drive units have components used for drilling which preclude use of a pack-off and sheave wheels necessary for operation of a wireline. For instance, the Varco top drive system has a gooseneck piping assembly above the top drive to supply circulation of fluid into the well bore.

In one type of wireline rig-up for free-point back-off operation, a wireline is hung in the derrick and run over the drilling blocks into the drill pipe that is secured to the drilling block. The drill pipe may be open ended or have a pack-off mounted thereon. This type of wireline rig up is subject to twisted wires if the top sheave rotates, and damaged wireline cable as the drilling block lifts and lowers the drill string, significant friction during wireline operation as literally miles of wireline frictionally engage steel surfaces such as the traveling block and the steel cables that control the traveling block for lifting the drill string, and premature failure of the wireline due to sharp bends taken by the wireline path through the derrick in such rig ups and the like.

Another type of rig up, typically used for slick line operation in lowering and retrieving tools within the bore hole with the drive member disconnected, have used a relatively small sheave mounted on the end of a drill pipe that also may have a pack-off thereon. This type of rigging has also occasionally been used during drilling with a downhole motor wherein the pipe at the surface does not rotate. This set up is not designed for either rotation of the drill pipe at the surface or reciprocation of the drill string with the lifting means. Furthermore, while the small sheave may be adequate for slick line operation that does not have a center electrical conductor, the sharp bend taken by the slick line around the small sheave is generally beyond the wireline specifications for the bend that can be taken by a wireline having an electrical conductor, especially if the wireline is placed under tension. There is no clearance room for a larger sheave between the hook and the top drive, not to mention the pack-off connections necessary.

Various types of side entry slots that allow wireline access to the drill string bore have been used during various types of operations. However, such systems may not always be suitable for the conditions encountered in free-point back-off operations for rotating and lifting the drill pipe while using wireline as required in the back-off operation. While some systems are much safer than others, it can generally be said that if rotation of drill pipe with the wireline therein or to the side thereof occurs, then there is risk of damaging the wireline.

For all of these reasons, problems concerning safety in free-point back-off operations have been tolerated by those skilled in the art for many years without finding a solution. Consequently, there remains a need for a safer method of providing back-off operations without the need to hold torque in the drill string with a pipe tong while the drill string is reciprocated and that also allows use of the wireline to locate the free point and for placement of the explosive charge. Those skilled in the art have long sought and will appreciate that the present invention provides solutions to these and other problems.

SUMMARY OF THE INVENTION

The present invention provides for an apparatus and method wherein a rotational guide assembly, such as sheave assembly, is rigidly secured between the pipe drive and the lifting block. At least one derrick sheave may be secured to the derrick with a cable. An elongate member, such as a wireline is threaded through the derrick sheave or sheaves to the sheave assembly and through the pipe drive. A downhole tool may be attached to the wireline.

The apparatus connects to a top portion of a tubular string to allow entry of a elongate member, such as a wireline, into a tubular bore within the tubular string. A block member, having a radial outer diameter, may be utilized for longitudinally and rotationally moving the tubular string. The apparatus generally includes a pack-off body defining therein a cavity for receiving sealing members in surrounding relationship to the elongate member. The pack-off body has a pack-off bore therethrough. The pack-off body is in communication with the tubular bore for receiving the elongate member through the pack-off body and into the tubular bore. A radially extending flange portion extends outwardly from the pack-off body is secured thereto. An sheave support arm is secured in cantilever fashion to the pack-off body. A first sheave is rotatably supported by the arm member for carrying the elongate member so as to guide the elongate member into the pack-off body bore. A second sheave is preferably rotatably supported by the arm member for guiding the elongate member into the first sheave.

In operation, the elongate member is guided into the pack-off body. The elongate member is bent in a first bending path at a first bending region as the elongate member emerges from the pack-off body such that the elongate member does not contact the lifting means, such as the hook or the traveling block, but moves radially outwardly with respect to the drill string. The elongate member is bent in a second bending region at a second bending position. The second bending region is in a fixed position such that it remains at a fixed distance as the lifting means provides longitudinal movement of the drill string assembly. The second bending region is disposed at a distance further radially outwardly than an outer diameter of both the lifting means and the pipe drive means. The elongate member is moved into the tubular bore through the first and second bending paths. The tubular pipe assembly is typically lifted with the traveling block and hook assembly and may also be rotated with a top-drive unit.

It is an object of the present invention to provide a system that allows for operation of a top drive for both longitudinal and rotational movement of the drill string while still allowing wireline operation.

It is yet another object of the present invention to provide a pack-off sheave system that will be usable with even the largest traveling blocks and hooks that leave the smallest clearance between the bottom of the hook and the top of the top-drive unit.

A feature of the present invention is a flange or other tubular connection means may be readily fabricated onto the body of a pack-off and sheave support arm.

Another feature of the present invention is an arm secured in cantilevered fashion to the pack-off body which provides a path for a wireline to be placed in the well bore without damage or undue wear on the wireline or the block and top drive units.

Another feature of the present invention is the use of two sheaves fixably mounted with respect to a top drive.

An advantage of the present invention is the possibility of using a top sheave in the derrick or not as desired.

Another advantage is a fairly straight forward system to rig up for operation without a complicated wireline rigging system whereby the wireline engages the traveling block and hook or top drive.

Yet another advantage of the present invention is that it is largely comprised of standard components that are readily available in many locations.

Yet another advantage of the present is that it functions regardless of drill pipe size or pulling requirements because it is positioned at the top of the top drive unit.

These and other objects, features, and advantages of the present invention will become apparent from the drawings, the descriptions given herein, and the appended claims.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Figure 1:
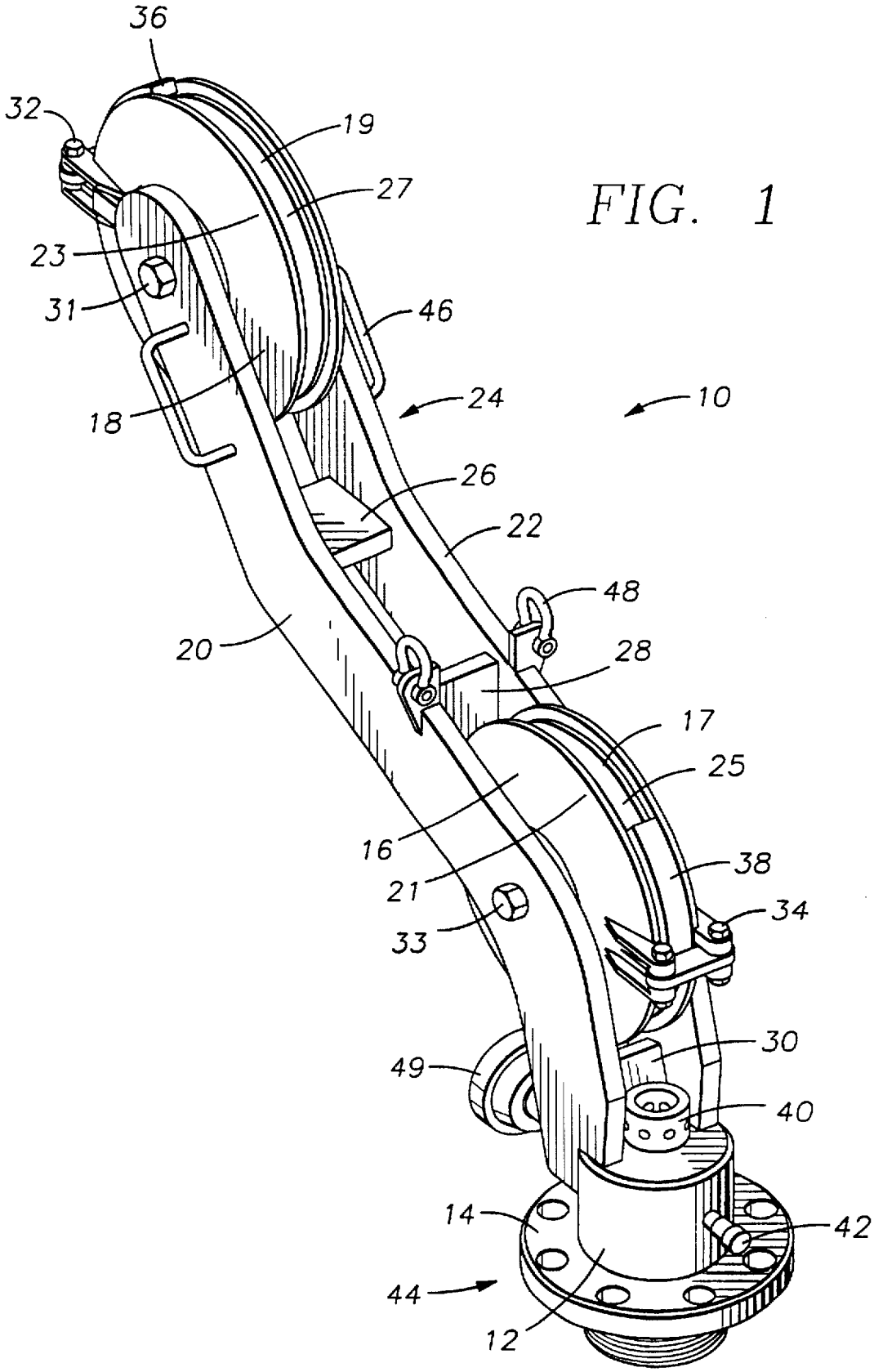
FIG. 1 is a perspective view of a top entry apparatus showing one preferred form of the present invention, in partial section.

Referring now to the drawings, and more particularly to FIG. 1, there is shown a top entry apparatus 10, in accord with the present invention.

While descriptive terms such as "above", "below", and the like, may be used herein to aid understanding of the present invention, it will be understood that these terms refer to the relative location of the components as illustrated in the accompanying drawings and may be disposed in different relationships in operation, storage, or transportation, as will be understood by those skilled in the art after studying the teachings of the present specification. Thus, it is not intended that the invention be construed as being limited in any manner by such terminology.

Top entry apparatus 10 includes a pack-off body 12 having flange 14 forming a portion of said body as a integral unit or secured thereto as by welding or other means. Flange 14 is designed to mate to a top drill pipe drive system in place of a gooseneck assembly as discussed hereinafter. Flange 14 is provided as part of pack-off body 12 to reduce the axial space requirements of top entry apparatus 10. The provision of flange 14 to form a body portion as part of pack-off 44 allows for a very significant reduction in axial space requirements. This is important due to the very small amount of axial space available between the top drive and the drilling blocks and hooks, especially when the larger size drilling blocks are used. Apparatus 10 is designed to operable even with the very largest drilling blocks that may sometimes be referred to as "National 5750" drilling blocks. While it is conceivable that operation without a pack-off could be utilized, in the presently preferred embodiment, a pack-off is provided. A wireline B.O.P. (blow out preventer) could also be used for this purpose if placed above circulation sub 47. This arrangement could allow for some additional axial space. However, as stated hereinbefore, the present invention is usable with all present size drill blocks.

Top entry apparatus 10 includes adjacent and distal sheaves 16 and 18, respectively. Sheaves 16 and 18 are preferably standard wireline sheaves that are adapted for operation with top entry apparatus 10. Sheaves 16 and 18 include inner rotatable wheels 17 and 19, respectively. Outer sheave housings 21 and 23 do not rotate but are fixed. Each rotatable wheel has a respective groove 25 and 27 around the circumference thereof that is sized according to the size of wireline that is used. The grooves 25 and 27 may be seen more readily in FIG. 2 and FIG. 3. Sheaves 16 and 18 are removable and may be changed out for use with different size wireline as desired. A common size wireline for free-point back-off operations as described above might be a 5/16 inch wireline.

The sheave wheels are secured between beams 20 and 22 that collectively form sheave support arm 24. Braces such as brace 26, 28, and 30 support and strengthen sheave support arm 24. Sheave support arm 24 is preferably fixably secured to pack-off body 12 by welding or other means so as to be mounted in cantilever fashion therefrom. Bolts 31 and 33 are used to secure sheaves 18 and 16, respectively, in place within sheave support arm 24.

Top entry apparatus 10 is, in a presently preferred embodiment, used to support a wireline for entry through a top drive as discussed hereinafter. The wireline may be threaded through sheaves 16 and 18 and then clamped therein with hinges 32 and 34 that allow wireline shields 36 and 38, respectively, to open and close.

Pack-off nut 40 may be used to secure standard wireline pack-off sealing elements discussed hereinafter within a cavity therein. Hydraulic quick connect 42 may be coupled to a hydraulic line (not shown) to operate pack-off 44 that consists of pack-off body 12, flange 14, pack-off nut 40, the internal pack-off components, and other standard parts.

Handles 46 are available to help support sheave wheel arm 24 during installation in conjunction with U-damps 48 that are connected to cat lines during installation. U-clamps 48 may also be used to brace sheave wheel arm 24 during operation as with steel cables or chains (not shown).

Flow line 49 is provided to allow pumping into the drill stream for circulation purposes as desired. Flow line 49 and circulation sub 47 are connected to a conventional valve and fluid flow line (not shown). Alternatively, a circulation sub 47 and valve arrangement may also be provided in drill pipe 50 as shown in FIG. 7.

Figure 7:
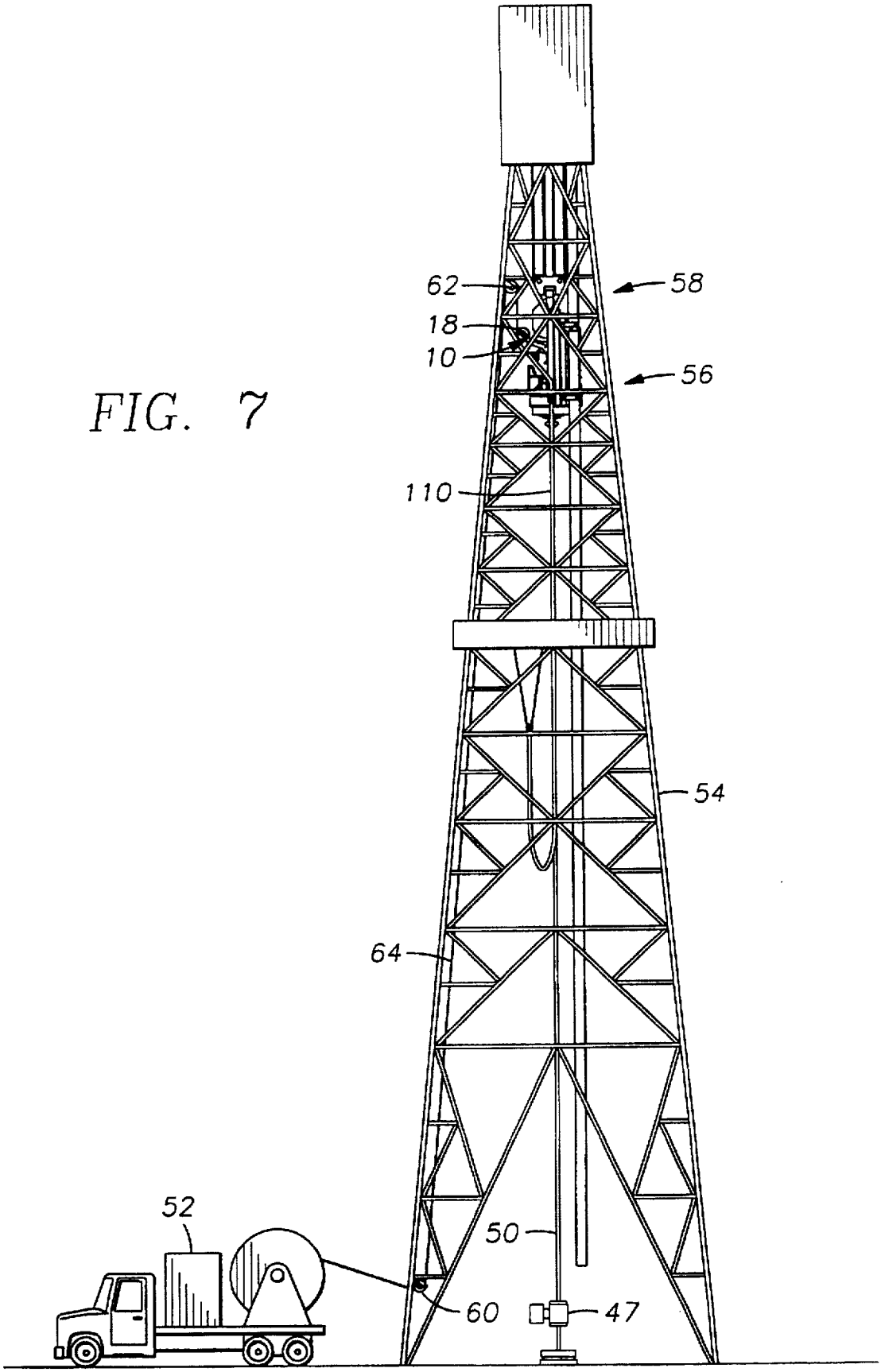
FIG. 7 is an elevation view of a top drive drilling rig with a top entry apparatus in accord with the present invention installed thereon.

FIG. 7 provides an overview of the overall drilling system. Wireline unit 52, that may of course also be a skid mounted unit or the like, is rigged up for operation in derrick 54. Drill pipe 52 may be rotated by top drive unit 56. Top drive unit 56 is supported by drilling blocks 58. In this wireline rigging arrangement, there is lower sheave 60 and upper sheave 62 that supports wireline 64. Wireline 64 is fed to distal sheave 18 of top entry apparatus 10 that is mounted between drilling blocks 58 and top drive unit 56. Lower and upper sheaves 60 are normally secured to derrick 54 by means of a strength cable or chain arrangement.

As shown in FIG. 7, top entry apparatus 10 may be used with only lower sheave 60 as desired. Providing an upper sheave 62 allows the pipe to be moved without affecting the position of the wireline to thereby keep the wireline measurements constant. If only the lower sheave 60 is used, then movement of the drill pipe causes the wireline to also move. However, since this movement will not be too great if the pipe is stuck, it may be desirable simply to eliminate the need to rig up upper sheave 62. Typically rigging up time for an upper sheave such as sheave 62 is about 15–30 minutes. Another consideration in whether to use an upper sheave is that while using only the lower sheave, movement of the wireline while stretching the pipe may affect free-point tool operation because of the corresponding cable movement, and therefore consideration of the type of free-point tool used is necessary.

Figure 2:
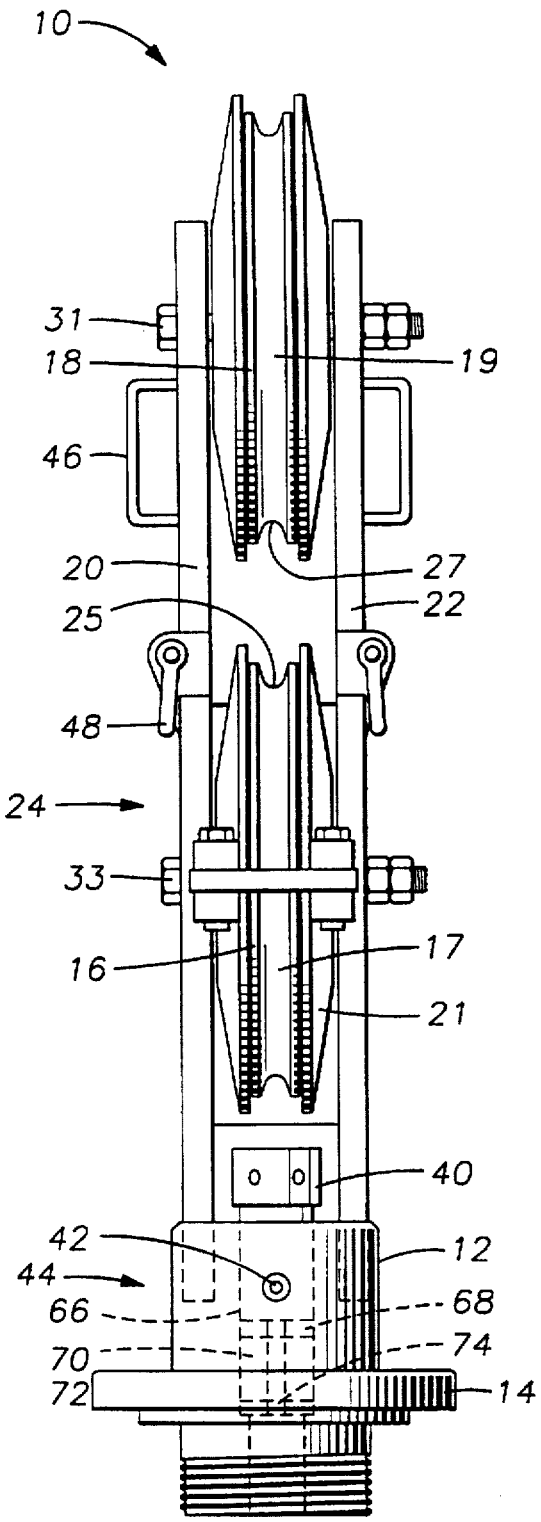
FIG. 2 is an elevation view of the top entry apparatus of FIG. 1 in partial section.
Figure 3:
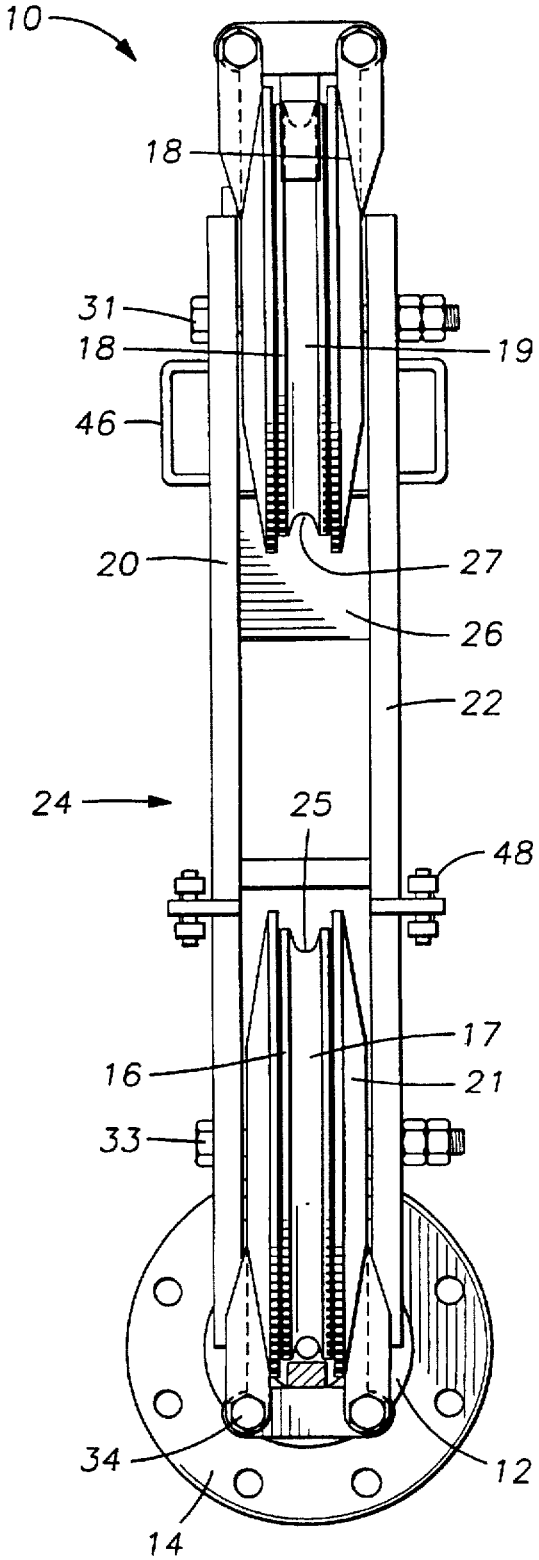
FIG. 3 is a top view of the top entry apparatus of FIG. 1; in section.

Referring to FIG. 2, it will be seen that cavity 66 in pack-off 12 is provided for standard sealing elements that may include split upper brass elements 68, split elastomeric elements 70, and split lower brass elements 72. The elements are typically split to facilitate assembly. A bore or hole 74 is provided through the sealing elements that is sized for the particular size wireline used. If a different size wireline is used, then the sealing elements may be readily changed out. Hydraulic pressure provided through hydraulic quick connect 42 results in compression of the components as with a piston member. Other types of relatively short length sealing elements could be used such as grease seals and the like that are sometimes preferably used for higher pressure operations with the wireline being movable at relatively high speeds without losing the seal. Smaller diameter wire is preferable for high pressure work. Standard pack-offs with standard pack-off elements will typically seal with a stationary 5/16 inch wireline at about 5,000 to 10,000 psi. depending on the condition of the wireline; i.e., if the wireline is packed or covered with grease or well oiled then the seal will be higher.

Figure 4:
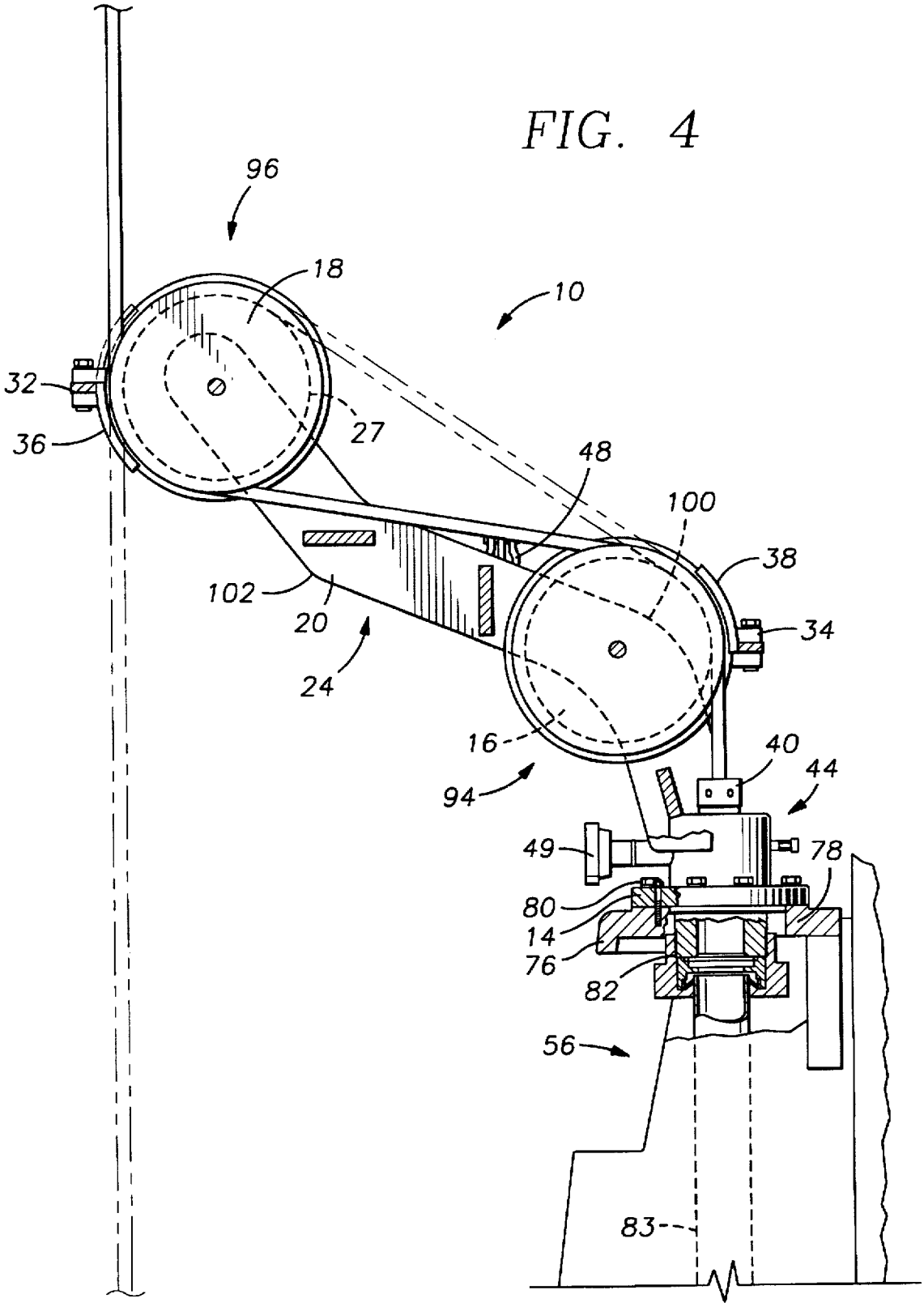
FIG. 4 is an elevation view, partially in section, of a top entry apparatus mounted to a top-drive system.

In FIG. 4, top entry apparatus 10 is secured to top drive unit 56. It will be understood that part of method of the present invention first requires removal of the gooseneck assembly whereby an upper top drive frame 76 is accessible to provide flange connection 78 to mate with flange 14 on pack-off 44. Top entry apparatus 10 is thereby preferably bolted and/or threadably secured as with bolts 80 and threaded pin/socket connections 82. Thus, access is available to drill pipe tubular bore as indicated schematically in dash as drill pipe bore 83 wherein it will be understood that the drill pipe may be located further below the indication and be of various sizes.

A feature of the present invention is that it allows a choice in rig ups with the associated derrick sheave(s). A lower sheave 60 may be used alone with top entry apparatus 10. Alternatively, an upper 62 and lower 60 sheaves may be used as with the presently preferred rig up, at least for free-point back-off operation. Relative advantages of the different rig ups for the free-point back-off operation have been discussed hereinabove. However, this unique rig up feature can be very useful in other types of rig up situations. For instance, in multi-well offshore rigs, it may be necessary to have multiple sheaves located at multiple levels due to well-head access problems that may occur in those situations whereby the wireline unit may be located on a different level and at a different part of the offshore rig. The flexibility of being able to direct the wireline in either direction could be quite helpful in those rig up situations. It may also be helpful and for other situations that may be encountered or already known to those skilled in the art.

Figure 6:
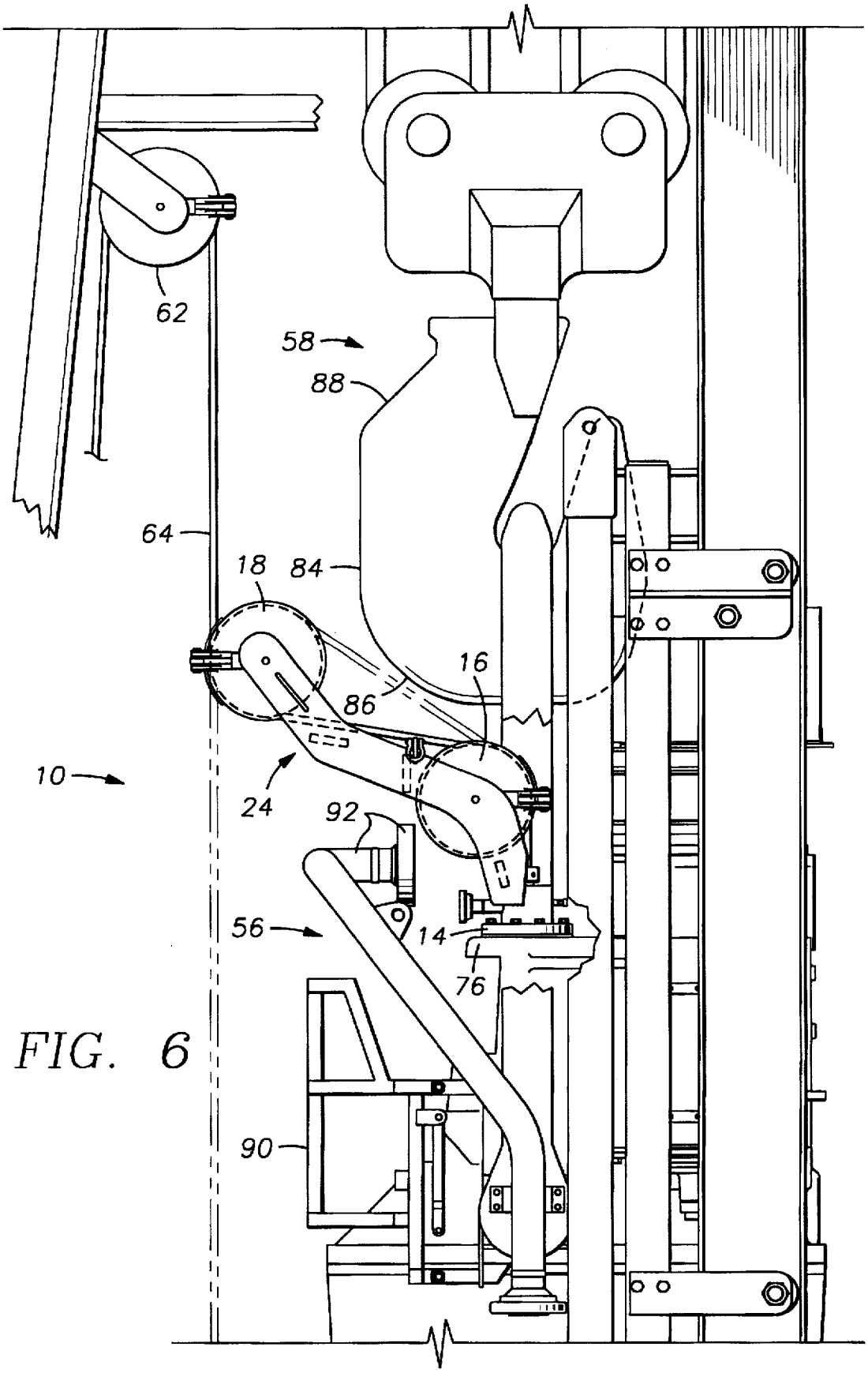
FIG. 6 is an elevation view of the top drill pipe drive system of FIG. 5 with a top entry apparatus installed thereon.

This unique rig up feature of the present invention can be seen in FIG. 4 and FIG. 6 where the preferred wireline 64 rig up for free-point back-off operation is indicated in solid lines. The optional single lower sheave wheel rig up for wireline 64 is indicated in dashed lines.

For the preferred rig up indicated by solid lines, clearances are provided such that wireline 64 does not contact an outer diameter 84 or lower surface 86 of hook portion 88 of traveling block 58. If the single sheave rig up is used, then clearances are provided such that wireline 64 does not contact an outer diameter region 90 or upper surface region 92 of top drive unit 56.

Moreover, the angles provided for bending the wireline are designed not only to avoid engagement or frictional rubbing with equipment that is in a confined region, but also is designed to be within the bending specifications for wirelines having electrical conductors. The sheaves are preferably of the approximately 14 inch diameter readily available standard type that is often used with single conductor 5/16 inch wireline cable. However, due to the use of decreased bending angles, even multi-conductor cable or larger diameter cable may be used as specifications allow.

Referring to FIG. 4, as wireline 64 emerges from pack-off 44 it encounters a first bending region 94 that is provided by adjacent sheave wheel 16. First bending region 94 preferably ranges from about sixty degrees to about eighty degrees depending on the type of rig up. If cable 64 goes over both sheave wheels 16 and 18, then the angle of first bending region is decreased. Although the presently preferred embodiment bends as shown, top entry apparatus 10 could have different bending angles as from about twenty to over ninety degrees. For other rigging situations in which the present invention may be used, different angles are possible. It will be understood that although the preferred embodiment of the present invention is directed to use with top drive systems, it is not intended to be so limited and may be used with other operations that involve other rigging requirements.

A second bending region 96 for wireline 64 is provided at a radially outwardly position from the drill pipe 50, traveling block 58, and top drive unit 56. Thus, top entry apparatus 10 effectively controls the path of the wireline and directs it radially outwardly to a safe position. Second bending region 96 will remain at a constant fixed distance form upper top drive frame 76 as block 58 moves the pipe string longitudinally. Second bending region 96 bends wireline cable 64 by an amount of from about one-hundred degrees for the preferred rig up to about one-hundred thirty five degrees for the single derrick sheave rig up. As with the first bending region, these angles could be varied for use of the present invention in other rig up situations as desired. The position of the bending region may be designed by placement of the sheave and the position of bend 102 in the sheave support arm 24.

Sheave support arm 24 may be of various shapes, however in the presently preferred embodiment it is provided generally with an S-shape. A first bend 100 is provided proximate to pack-off 44 and a second bend 102 is provided distal from pack-off 44. Other configurations and positions of bends in support arm 24 could also be provided. Sheave support arm 24 is braced and dimensioned so as to be able to withstand a substantial moment acting on it as will applied in different directions depending on the type of derrick sheave rig up. U-bolt 48 may be used to brace sheave support arm 24 with cables or chains as discussed hereinbefore.

Figure 5:
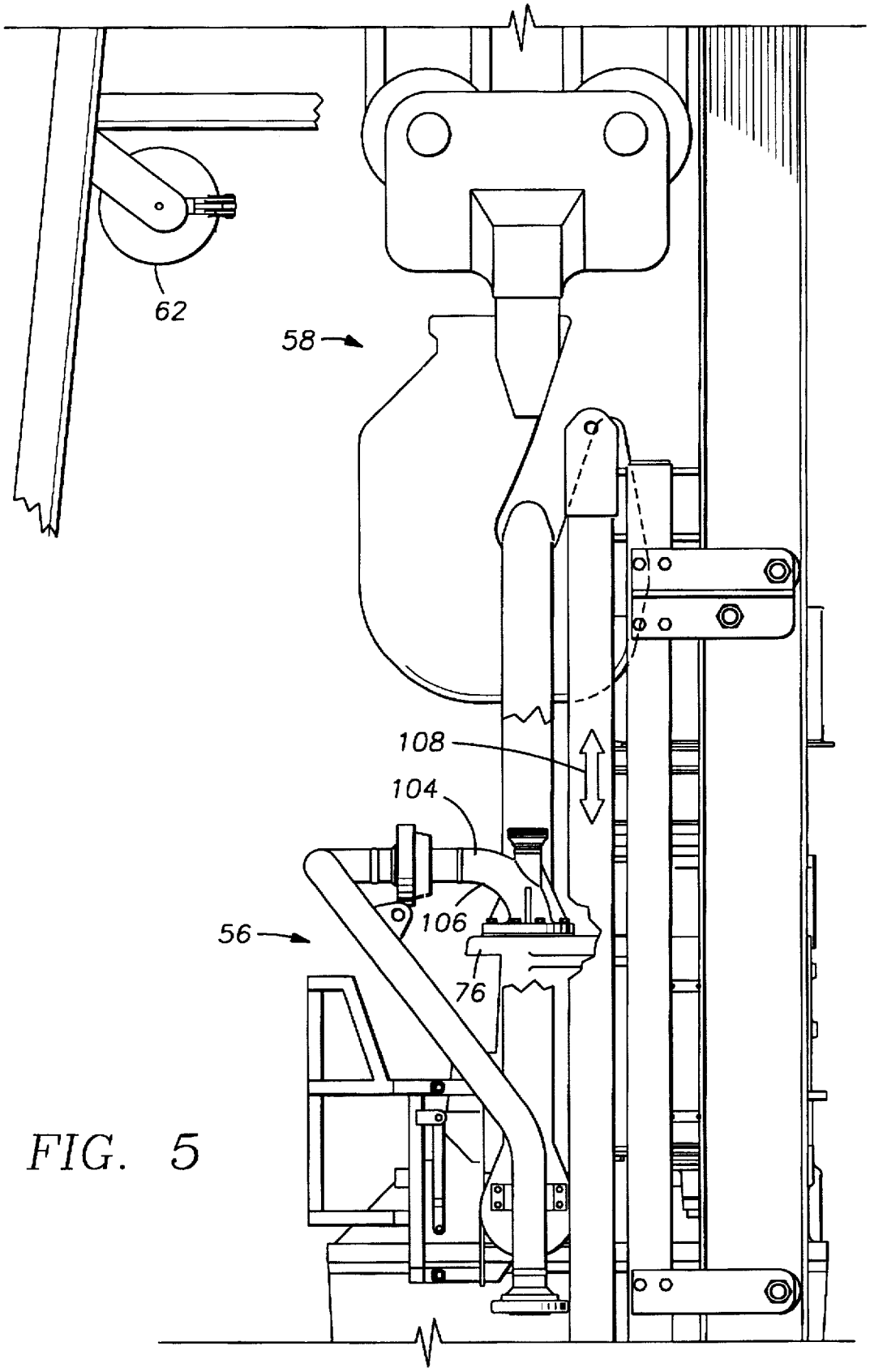
FIG. 5 is an elevation view of a top-drive system supported with a gooseneck assembly for circulation and being supported by drilling blocks.

FIG. 5 shows the top drive unit 56 with gooseneck flow line 104 connected thereto. This is the situation before rig up of the present invention and after rig down. Thus, riser portion 106 of the circulation flow line is removed and replaced before and after the free-point back-off operation, respectfully. While there is very little axial clearance 108 in this region, the present invention allows for wireline operation in a very tight situation without frictionally engaging the wireline on surfaces that may be otherwise damaged. With the use of the largest hook 88 and drilling block 58 known to applicant, the axial clearance 108 is approximately 13 inches. It will be understood that while the present invention is directed to use of wireline such as wireline 64, other types of flexible line members may also conceivably be used such as a very flexible coiled tubing as may be available at the present or in the future. The two-sheave fixed assembly of the present invention is therefore adaptable to other operation and with other rotational devices such as, by way of example only, roller systems. Furthermore, the concept of a sheave support arm 24 being cantilevered from the pack-off 44 may be applied to additional sheaves in such an arm to provide smaller bends and/or greater radially movement of a flexible elongate line member.

In operation, the first step for rigging up is to disconnect gooseneck flow line 104 at the top of top drive unit 56. Top entry apparatus is then preferably bolted onto or otherwise secured as with securing member flange 14. The drill pipe is set in slips and at least one pipe such as top pipe 110 is disconnected using top drive unit 56. The top sheave may be rigged up if it is used. The wireline from the appropriate derrick sheave, that may be either an upper or lower sheave, is then threaded or stripped through top entry apparatus 10 by opening hinges 32, 34 and then closing guards 36, 38 to maintain the wireline in the sheaves. The cable head may then be striped or threaded through the pack-off and through the drill pipe. The pack-off sealing elements are then positioned into the pack-off and pack-off nut 40 is tightened. A downhole tool, such as a collar locator, a string shot or a free-point tool or a combination of such tools well known to one skilled in that art, may be connected to the cable head. Wireline unit operator can then pull the tool up into the top pipe 110 using wireline unit 52. The drill pipe can then be reattached and the wireline operation may proceed. If it is necessary to pump into the pipe, then flow line 49 or circulation sub 47 may be used. The top drive unit 56 can be used to rotate, apply torque, and lift the drill pipe string using drill block 58. In this manner, it is now no longer necessary to use a pipe tong to maintain torque on the drill string as the drill string is moved longitudinally.

Figure 8:
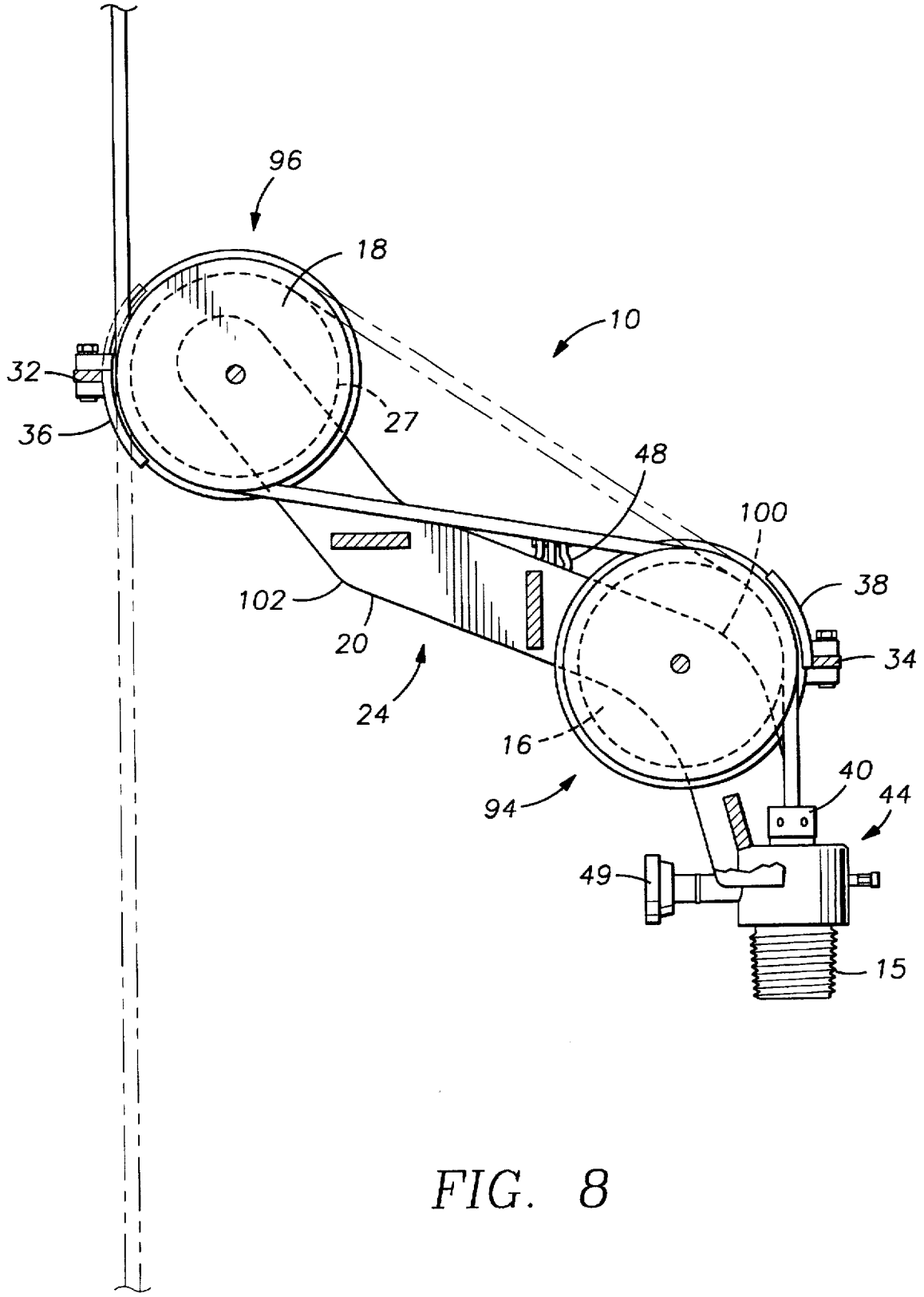
FIG. 8 is an elevation view of the alternative embodiment of a top entry apparatus adapted for use with threaded tubulars.

In the alternative embodiment shown in FIG. 8, the top entry apparatus 10 is provided with threaded connections 15 for releasably connecting a device with standard tubular members used for the drilling of wells. All other like-numbered components are the same as those described and discussed above in connection with FIGS. 2, 3, and 4.

Figure 9:
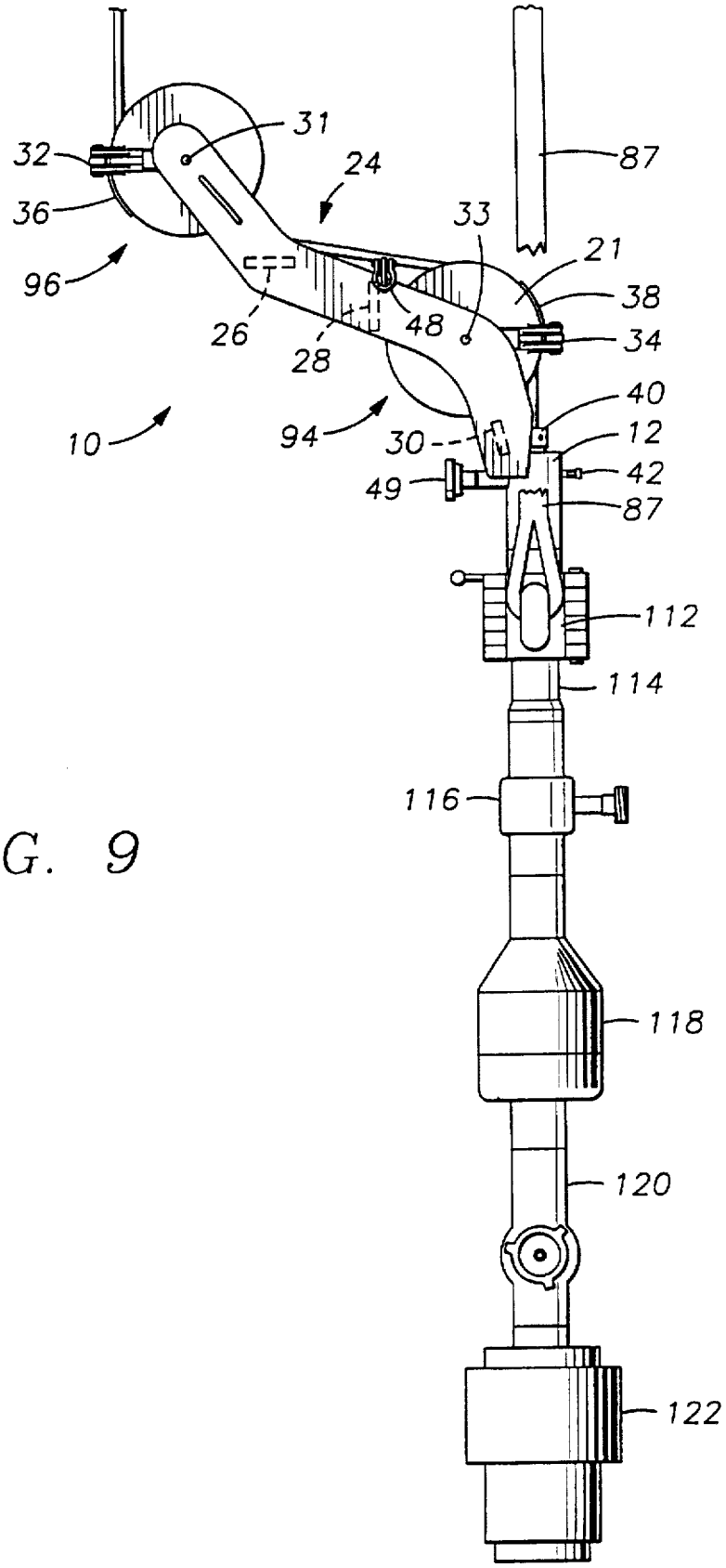
FIG. 9 is an elevation view of the alternative embodiment of FIG. 8 with the top entry device connected to the lifting sub, swivel and top entry drive body.

Referring to FIG. 9 which is a partially schematic drawing of an alternative embodiment, the top entry apparatus 10 is releasably connected to a lifting sub or pup joint 114, which is supported by elevators 112. Elevators 112 are releasably engaged to clamp around the shoulder or upset portion of the lifting sub 114 in conventional manner. The elevators 112 are connected to bails 87 which are carried by conventional hook assembly 88 such as shown in FIG. 6 or other connection means of the traveling block 58, well-known to those skilled in the art.

As an alternative to pump-in 49, the lifting sub 114 may be connected to a circulation sub 47 (as shown in FIG. 7) or to pump-in sub 116 as shown in FIG. 9 for the attachment of the conventional valve and hydraulic line (not shown) to permit the continuance of fluid flow during the wireline operations. A conventional in-line swivel 118 is attached below the lifting sub to permit the tubular drill string 110 (as shown in FIG. 7) below to rotate. The in-line swivel 118 is attached to the top of other forms of top-drive units known in the art, such as older versions of the Varco top-drive units 122, in an arrangement shown schematically here, which supplies rotational force to the drill string 110 which is threadably connected to said top-drive unit 122 in a conventional manner during the wireline operation as desired. It may be appreciated by those skilled in the art that other subs may be placed in the arrangement of the alternative embodiment shown in FIG. 9 as preferred. FIG. 9 shows valve sub 120 which provides a means of regulating the fluid flow through the top drive unit 122 before and after wireline operations, while the apparatus is connected and disconnected for normal drilling operations.

The foregoing disclosure and description of the invention is illustrative and explanatory thereof, and it will appreciated by those skilled in the art, that various changes in the size, shape and materials as well as in the details of the illustrated construction or combinations of features of the various top entry system elements may be made without departing from the spirit of the invention.

What is claimed is:

1. An elongate-member guide for use between a lifting means for longitudinal movement of a drill string and a top-drive for rotational movement of a drill string, said elongate-member guide including a first bending means and a second bending means.

2. The elongate-member guide of claim 1 wherein said first bending means is secured on the drill string.

3. The elongate-member guide of claim 1 wherein said first bending means is adjacent the axis of longitudinal movement of the drill string.

4. The elongate-member guide of claim 1 wherein said top-drive has an outer-surface and wherein said second bending means is spaced outwardly relative to said outer surface of said top-drive and is secured to said first bending means.

5. Apparatus connecting to a top portion of a tubular string to allow entry of a elongate member into a tubular bore within said tubular string, said apparatus comprising:

a body portion;

securing means for securing said body portion with respect to the top portion of said tubular string;

a sheave support secured with respect to said body portion and extending radially outwardly from said body portion;

a first sheave supported by said sheave support for carrying said elongate member so as to guide said elongate member into said tubular bore within said tubular string; and a second sheave supported by said sheave support for guiding said elongate member onto said first sheave.

6. The apparatus of claim 5, wherein said body portion is:

a pack-off body.

7. The apparatus of claim 5, wherein said elongate member is:

a wireline cable.

8. The apparatus of claim 5, wherein said sheave support:

has a generally S-shaped configuration.

9. The apparatus of claim 5, wherein the apparatus includes:

a tubular string support structure for supporting said tubular string;

a third sheave for guiding said elongate member onto said second sheave; and attachment means for securing said third sheave to said derrick.

10. The apparatus of claim 9, which apparatus further includes:

a swivel portion having a bore therethrough, said swivel connecting to the tubular string.

11. The apparatus of claim 5, wherein the apparatus has:

at least one cable connector disposed in a portion of said sheave support.

12. The apparatus of claim 5, wherein the apparatus has:

at least one handle on said sheave support.

13. The apparatus of claim 5, wherein said body portion further defines a flow passageway in communication with said tubular bore.

14. A method for entering a top portion of a tubular pipe assembly having a tubular bore therein with an elongate member, a lifting block for moving said tubular pipe assembly and a pipe drive, said pipe drive being operable to rotate said tubular pipe for drilling and having a relatively non-rotational upper member with respect to said lifting block, a support structure for said lifting block, said method comprising:

guiding said elongate member from said tubular bore at said top portion of said tubular pipe assembly;

guiding said elongate member adjacent said relatively non-rotational upper member;

first bending said elongate member in a first bending path at a first bending region adjacent said relatively non-rotational upper member such that said elongate member does not contact said lifting block but moves radially outwardly with respect to said tubular pipe;

second bending said elongate member in a second bending path at a second bending region, said second bending region being at a fixed distance from said relatively non-rotational upper member that remains at said fixed distance as said lifting block lifts said tubular pipe assembly, said second bending region being disposed at a distance further radially outwardly than an outer diameter of said lifting block; and lifting said tubular pipe assembly with said lifting block.

15. The method of claim 14, wherein said step of first bending said elongate member is:

bending said elongate member by less than ninety degrees.

16. The method of claim 14, wherein said step of first bending said elongate member is:

bending said elongate member by an amount in a range from about sixty to eighty-five degrees.

17. The method of claim 14, wherein said step of first bending said elongate member is:

bending said elongate member by an amount in a range from about twenty to sixty degrees.

18. The method of claim 14, wherein said step of guiding said elongate member is:

bending said elongate member in a third bending path at a third bending region, said third bending region being fixed with respect to said support structure and movable with respect to said lifting block.

19. The method of claim 14, wherein said step of second bending said elongate member is:

selectively bending said elongate member towards a position above said lifting block.

20. The method of claim 14, wherein said step of second bending said elongate member is:

selectively bending said elongate member towards a position below said lifting block.

21. A method of rigging up a wireline in a derrick for entry into a tubular string assembly, a pipe drive being operable to rotate said tubular string assembly, a lifting block being operable for reciprocating said tubular string assembly including said pipe drive, said method comprising:

securing a sheave assembly to an upper portion of said pipe drive between said pipe drive and said lifting block;

attaching at least one derrick sheave to said derrick;

running said wireline through said sheave assembly and said at-least one derrick sheave and said pipe drive; and attaching a downhole tool to said wireline.

22. The method of claim 21, wherein the method includes:

sealing around said wireline at said pipe drive.

23. The method of claim 21, wherein the method includes:

pumping into said tubular string.

24. The method of claim 23, wherein said step of pumping includes:

pumping into said tubular string through a portion of said sheave assembly having a flow line therein.

25. The method of claim 21, wherein the method includes:

removing a mud line to uncover a flange, and securing said sheave wheel assembly to said flange.

26. The method of claim 21, wherein the method includes:

unscrewing an upper tubular from tubular string with said pipe drive; and threading said wireline through said pipe drive and said upper pipe.

27. A method for rigging up a elongate member in a derrick, a pipe drive unit being supported in said derrick operable for rotating a drill pipe string, said method comprising the following steps:

removing a flow line from a top portion of a pipe drive unit;

securing a guide assembly to said top portion of said pipe drive unit;

threading said elongate member through said guide assembly and said pipe drive unit;

lifting said drill pipe string and said pipe drive unit;

moving said elongate member through a bore in said drill pipe string; and rotating said drill pipe with said pipe drive unit.

28. The method of claim 27, wherein the method includes:

sealing around said elongate member at said top portion of said pipe drive unit.

29. The method of claim 27, wherein the method includes:

threading said elongate member between a sheave secured to a lower portion of a derrick for directing said elongate member to said guide assembly.

30. The method of claim 27, wherein the method includes:

threading said elongate member between a sheave secured to a lower portion of a derrick to a sheave secured to an upper portion of said derrick and then to said guide assembly.

31. An apparatus for guiding a elongate member into a tubular bore of a pipe string, comprising:

a pipe drive member operable for rotating and supporting said tubular pipe string;

an arm member extending radially outwardly with respect to said tubular pipe string;

a securing member for securing said arm member with respect to said pipe drive member; and a guide member carried by said arm member for supporting said elongate member.

32. The apparatus of claim 31, wherein the guide member is:

a sheave.

33. The apparatus of claim 31, wherein said pipe drive is:

a top drive member.

34. The apparatus of claim 31, wherein said pipe drive includes:

a swivel member.

35. A method for entering a top portion of a tubular string with an elongate member, comprising the steps of:

removing a swivel portion from a top portion of a pipe drive;

securing a sheave to said top portion;

providing a second swivel portion between said sheave and said tubular string; and introducing said elongate member into a bore of said tubular string.

36. The method of claim 35, wherein the method includes:

removing a mud flow line from said top portion of said pipe drive; and connecting a pump in sub.

37. The method of claim 35, wherein:

said pipe drive is a top drive.

38. The method of claim 35, further comprising:

said step of securing a sheave to said top portion further comprises threadably engaging a pup joint.

39. An apparatus for entering a top portion of a pipe string in a derrick with a elongate member, said top portion of said pipe string including a swivel member, said swivel member having a bore therethrough, said swivel member having a first end portion and a second end portion rotatable with respect to each other, said pipe string being secured to said second end portion, said apparatus comprising:

a sheave support member secured to said first end portion for rotation with respect to said pipe string;

a sheave mounted to said sheave support member, said sheave being operable to guide said elongate member into said bore of said swivel for entering said pipe string.

40. The apparatus of claim 39, wherein said elongate member is:

a wireline cable.

41. The apparatus of claim 39, wherein said apparatus includes:

a pipe drive member for rotating said pipe string.

42. The apparatus of claim 39, wherein said apparatus includes:

a second sheave secured to said sheave support member.

43. The apparatus of claim 39, wherein said apparatus includes:

a third sheave attached to said derrick.

44. A traveling block assembly movable longitudinally in a derrick, said derrick having an upper portion spaced distal from a ground level and a lower portion adjacent said ground level, said block assembly supporting a tubular string between an upper position and a lower position in said derrick, said tubular string having a bore therethrough for receiving a elongate member, said assembly comprising:

a block member, said block member having an engagement end adapted for engagement with an upper end of said tubular string;

a moving sheave affixed to said tubular string adjacent said engagement end of said block member for movement in a longitudinal direction with said block member and said tubular string;

a sheave secured to said derrick at said upper portion of said derrick, said second sheave being operable to direct said elongate member to said moving sheave, said moving sheave being radially disposed with respect to said tubular string at a radial distance such that said elongate member does not engage said block member as said block assembly moves between said upper position and said lower position in said derrick.

45. The traveling block assembly of claim 44, wherein said assembly includes:

a second moving sheave being movable with said first movable sheave.

46. A method for entering a top portion of a tubular string with an elongate member through a pipe drive, comprising the steps of:

removing a fluid flow line portion from a top portion of the pipe drive;

securing a sheave to said top portion; and introducing said elongate member into a bore of said tubular string.

47. The method of claim 46, wherein the method includes:

removing a swivel portion from said top portion of said pipe drive.

48. The method of claim 46, wherein the step of securing a sheave to said top portion includes:

threadably engaging a sheave on a pup joint.

49. A method for introducing a elongate member into a tubular bore of a tubular string:

providing a sheave for carrying said elongate member;

securing one end portion of a swivel connector with respect to said tubular string;

providing a swivel bore through said swivel connector in communication with said tubular bore of said tubular string;

securing a second end portion of said swivel connector with respect to said sheave; and guiding said elongate member through said swivel bore into said tubular bore.

50. The method of claim 49, wherein the method includes:

connecting a second sheave to said second end portion of said tubular string.

51. The method of claim 49, wherein the method includes:

securing a derrick sheave to a derrick; and moving said first sheave with respect to said derrick sheave with said swivel.

52. The method of claim 49, wherein the method includes:

rotating said tubular string with a pipe drive member.

53. An apparatus connecting to the top portion of a tubular member above the rotational force applying means and below the longitudinal movement means to allow entry of a substantially flexible elongate line member into a tubular bore within said tubular string while accommodating rotational and longitudinal movement of the tubular member relative to the flexible member, said apparatus comprising:

transport means for movement of a flexible member radially relative to the well-bore so as to guide said substantially flexible elongate member into and out of said tubular bore within said tubular string and independent of the rotational and longitudinal movement of the tubular string;

support means for said transport means attached to the top portion of the tubular string aboved the rotational force applying means, and extending radially outwardly from said tubular string; and, securing means for securing said support means with respect to said top portion of said tubular string above the rotational force applying means and providing attachment to the longitudinal movement means.

54. The apparatus of claim 53 wherein the flexible member is a wireline.

55. The apparatus of claim 53 wherein the flexible member is coiled tubing.

* * * * *